US009821571B2

(12) United States Patent
Ohnishi

(10) Patent No.: US 9,821,571 B2
(45) Date of Patent: Nov. 21, 2017

(54) INKJET PRINTER AND PRINTING METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/652,789

(22) PCT Filed: Dec. 16, 2013

(86) PCT No.: PCT/JP2013/083590
§ 371 (c)(1),
(2) Date: Jun. 17, 2015

(87) PCT Pub. No.: WO2014/098019
PCT Pub. Date: Jun. 26, 2014

(65) Prior Publication Data

US 2015/0321488 A1 Nov. 12, 2015

(30) Foreign Application Priority Data

Dec. 19, 2012 (JP) ..... 2012-276484

(51) Int. Cl.
*B41J 2/15* (2006.01)
*B41J 2/21* (2006.01)
*B41J 11/00* (2006.01)

(52) U.S. Cl.
CPC ..... *B41J 11/002* (2013.01); *B41J 2/15* (2013.01); *B41J 2/2103* (2013.01)

(58) Field of Classification Search
CPC ..... B41J 2/2103; B41J 2/2135; B41J 11/002
See application file for complete search history.

(56) References Cited

U.S. PATENT DOCUMENTS 6,022,104 A * 2/2000 Lin ..... B41J 11/002 347/102
2005/0179725 A1* 8/2005 Matsushima ..... B41J 2/2114 347/40

(Continued)

FOREIGN PATENT DOCUMENTS

JP 60-132767 7/1985
JP 2001-152061 6/2001

(Continued)

OTHER PUBLICATIONS

"International Search Report (Form PCT/ISA/210)", dated Mar. 18, 2014, with English translation thereof, pp. 1-4, in which five of the listed references (JP2008-194827A, JP2003-001807A, JP2001-152061A, JP2001-277494A and JP2012-214009A) were cited.

(Continued)

*Primary Examiner* — Kristal Feggins
*Assistant Examiner* — Kendrick Liu
(74) *Attorney, Agent, or Firm* — JCIPRNET

(57) ABSTRACT

The object is to suitably satisfy a condition for preventing smearing of a printed object and a condition for endowing glossiness to the printed object. As a solution therefor, a plurality of inkjet heads (12*y*, 12*m*, 12*c*, 12*k*), a print heater (104) being a medium heating heater, and a sub-scan driving unit (16) being an opposing position changing unit that sequentially causes each of positions in a medium (50) in a moving direction of the medium (50) to oppose the respective inkjet heads (12*y*, 12*m*, 12*c*, 12*k*) are provided, where ink is ink containing solvent and is fixed onto the medium (50) by the solvent being dried, and the print heater (104) dries the ink that has been discharged from one of the inkjet heads and struck onto the medium before another inkjet head further discharges an ink droplet onto a struck position of the ink.

8 Claims, 5 Drawing Sheets

(56) References Cited

U.S. PATENT DOCUMENTS

| | | | | |
|---|---|---|---|---|
| 2007/0076076 | A1* | 4/2007 | Niekawa | B41J 2/2103 347/102 |
| 2008/0204537 | A1* | 8/2008 | Suzuki | B41J 11/06 347/102 |
| 2009/0153613 | A1* | 6/2009 | Yamanobe | B41M 5/0017 347/21 |
| 2012/0156444 | A1* | 6/2012 | Takemoto | B41M 3/12 428/195.1 |
| 2013/0021403 | A1* | 1/2013 | Sonehara | B41J 11/0015 347/16 |
| 2015/0049139 | A1* | 2/2015 | Arnabat Benedicto | B41J 11/005 347/19 |
| 2015/0138289 | A1* | 5/2015 | Iijima | B41J 11/002 347/102 |

FOREIGN PATENT DOCUMENTS

| | | |
|---|---|---|
| JP | 2001-277494 | 10/2001 |
| JP | 2003-001807 | 1/2003 |
| JP | 2008-194827 | 8/2008 |
| JP | 2008194827 | 8/2008 |
| JP | 2012-214009 | 11/2012 |

OTHER PUBLICATIONS

"Office Action of Japan Counterpart Application" with English translation thereof, dated Oct. 11, 2016, p. 1-p. 7.
"Search Report of Europe Counterpart Application" , dated Feb. 13, 2017, p. 1-p. 4.
"Office Action of Japan Counterpart Application," with English translation thereof, issued on Jun. 27, 2017, pp. 1-6.

* cited by examiner

INKJET PRINTER AND PRINTING METHOD

TECHNICAL FIELD

The present invention relates to an inkjet printer and a printing method.

BACKGROUND ART

In recent years, an inkjet printer that performs printing in an inkjet scheme is widely used (for example, see Patent Document 1). The inkjet printer performs printing by discharging ink droplets from an inkjet head and forming ink dots on a medium. Further, in the inkjet printer, color printing is performed by using plural types of colors of ink that are different from each other.

PRIOR ART DOCUMENT

Patent Document

Patent Document 1: JP S60-132767 A.

SUMMARY OF THE INVENTION

Problem to be Solved by the Invention

In order to perform high quality printing in an inkjet printer, smearing of a printed object needs to be prevented, glossiness needs to be given to the printed object, and the like. Further, the smearing of the printed object is caused for example by ink being mixed by bleeding and the like at a boundary between ink dots of different colors that are formed on a medium in proximity. Due to this, to suppress the smearing of the printed object, the ink needs to be fixed to the medium before ink mixture is generated. Accordingly, to prevent the smearing of the printed object, normally, the ink needs to be fixed to the medium as soon as possible after having discharged the ink droplets onto the medium.

On the other hand, to endow glossiness to the printed object, the ink needs to be fixed to the medium by sparing some time during which the ink dot is spread to some extent after having discharged the ink droplets onto the medium. Due to this, if the time required to fix the ink on the medium is too short, then a sufficient glossiness cannot be obtained.

In this way, a condition for preventing the smearing of the printed object and a condition for endowing the glossiness to the printed object are normally in a trade-off relationship. Further, as a result, there are cases where it is difficult to suitably satisfy both the condition for preventing the smearing of the printed object and the condition for endowing the glossiness to the printed object.

For example, in recent years, it has become necessary to perform printing at a high resolution to address an increase in demands for print quality. However, in a case where the print resolution is high, intervals between ink dots on the medium becomes smaller, and a condition in which smearing more easily occurs is assumed. Due to this, in a case of performing printing at a high resolution, it becomes more difficult to suitably satisfy both the condition for preventing the smearing of the printed object and the condition for endowing the glossiness to the printed object.

Further, to perform faster printing, the ink needs to be fixed on the medium for a shorter time period. However, in this case, a time to allow the ink dot to sufficiently spread cannot be ensured, as a result of which a sufficient glossiness may not be endowed to the printed object. Due to this, in this case also, it becomes more difficult to suitably satisfy both the condition for preventing the smearing of the printed object and the condition for endowing the glossiness to the printed object.

Further, for example, in cases of using solvent-containing ink such as aqueous ink, solvent ink, solvent UV ink, latex ink and the like, normally it is necessary to evaporate the solvent by heating to fix the ink on the medium. However, in order to prevent a problem of ink drying generated at nozzle positions of the inkjet heads, a problem of cockling caused by overheating beyond heat durability of the medium and the like, the temperature of the medium cannot be made excessively high. Further, in order to perform printing at a sufficiently practical printing speed, the heating time cannot be elongated so much. Due to this, various restrictions are set even to a condition for heating the medium. Further, there are cases where it is difficult to suitably satisfy both the condition for preventing the smearing of the printed object and the condition for endowing the glossiness to the printed object due to the restrictions.

Due to this, conventionally, an inkjet printer that can suitably satisfy both the condition for preventing the smearing of the printed object and the condition for endowing the glossiness to the printed object has long been desired. Thus, the present invention aims to provide an inkjet printer and a printing method that can solve the above problems.

Solutions to the Problem

The inventor of the present application has eagerly conducted studies on a method for satisfying both the condition for preventing the smearing of the printed object and the condition for endowing the glossiness to the printed object in the case of using solvent-containing ink. The solvent-containing ink is for example aqueous ink, solvent ink, latex ink, solvent UV ink, and the like. With such ink, when dots of ink of different colors make contact before the solvent is dried, the ink is mixed by bleeding and the like at a boundary where ink of the respective colors makes contact, whereby a smearing occurs.

Thus, the inventor of the present application first considered repeating a step of performing printing on an entire surface of the medium by using only one color ink, for each of a plurality of colors of ink to be used (for example, ink for each of YMCK colors), over a number of times corresponding to the types of ink to be used (hereafter referred to as surface sequential printing). In this case, the generation of smear can suitably be suppressed by performing printing by one color ink and thereafter performing printing by next one color, after the entirety of the medium is sufficiently dried. Further, in this case, since the smear is not generated even by making the time used for the ink to be fixed onto the medium sufficiently long, glossiness can be given suitably to the printed object. Due to this, by configuring as above, the condition for preventing the smearing of the printed object and the condition for endowing the glossiness to the printed object can both be satisfied.

However, if printing is performed in such a method, the printing onto the entirety of the medium needs to be repeated over plural times, whereby time required for the printing is greatly increased. Further, in this method, a positional relationship of the medium and the inkjet heads needs to be adjusted at an accuracy corresponding to the resolution upon printing of each color ink. Due to this, for example, if the print resolution is high, it may become difficult to perform the alignment at a sufficient accuracy. Further, for example, in a case of an inkjet printer with a configuration to transfer the medium by rollers, burden of alignment becomes significantly large. Due to this, it is being desired to satisfy both the condition for preventing the smearing of the printed object and the condition for endowing the glossiness to the printed object by a more suitable method.

With respect to this, the inventor of the present application has further conducted eager studies, and has come to think of arranging positions of the medium in a feeding direction (for example, sub scanning direction) relative to the inkjet heads by offsetting the positions so as to offset timings when ink of different colors strike the same striking position, in a plurality of inkjets discharging ink droplets of different colors, for example, without using the surface sequential printing method. Further, in this configuration, it has been found that smearing can be prevented by suitably setting intervals between the inkjet heads and medium heating temperature. Moreover, according to this configuration, for example, it has been found that the condition for preventing the smearing of the printed object and the condition for endowing the glossiness to the printed object can both be suitably satisfied without greatly increasing the time required for printing and while suppressing the medium heating temperature in a suitable range. To solve the above problem, the present invention is provided with the following configurations.

(Configuration 1) An inkjet printer that performs printing on a medium by an inkjet scheme, the inkjet printer including: a plurality of inkjet heads that respectively discharge ink droplets of ink of different colors; a medium heating heater that heats the medium onto which the ink droplets has been discharged from the respective inkjet heads, by being arranged at a position opposing the plurality of inkjet heads with the medium intervened in between; and an opposing position changing unit that sequentially causes each position of the medium in a moving direction to oppose the respective inkjet heads, by feeding the medium in the moving direction that is predeterminedly and relatively set with respect to the plurality of inkjet heads, wherein the ink is ink that contains a solvent, and is fixed onto the medium by the solvent being dried, and the medium heating heater dries the ink that has been discharged from one of the inkjet heads and struck onto the medium by a time when another one of the inkjet heads further discharges an ink droplet to the struck position of the ink.

By configuring as above, for example, another ink can appropriately be prevented from further striking onto the position of the ink that has not yet been dried. Further, due to this, the ink smearing can appropriately be suppressed. Moreover, since it becomes possible to appropriately suppress the smearing of a printed object, the compatibility with a condition for endowing glossiness to the printed object can more easily be ensured.

It should be noted that, in this configuration, drying the ink by the medium heating heater may mean that the ink is to be dried to a degree that is sufficient to achieve the aim of preventing ink smearing. For example, drying the ink by the medium heating heater may mean to dry a surface portion of an ink dot to the degree that is sufficient to prevent the smearing.

Further, in this configuration, the relative moving direction of the medium with respect to the inkjet heads (hereinbelow referred to as the moving direction of the medium) may mean for example a feeding direction along which the medium is relatively fed with respect to the inkjet heads. Further, for example, in the case of the configuration in which the medium is transferred by a roller or the like, the feeding direction is the transferring direction of the medium.

Further, another one of the inkjet heads further discharging an ink droplet to the struck position of the ink by one of the inkjet heads means that, for example, another one of the inkjet heads discharges an ink droplet to one striking position where the ink droplet from the one of the inkjet heads has previously struck, at a timing when the another inkjet head opposes this position. More specifically, for example, it may mean that each of the inkjet heads discharges an ink droplet at different timings to a position corresponding to the same pixel of an image to be printed. Further, discharging ink droplets to the same striking position may for example not be limited to the case of being perfectly the same position, but also may mean to discharge the ink droplets to positions by which at least a part of the ink dots to be formed overlaps each other. That at least a part of the ink dots to be formed overlaps each other may mean that, for example, at least a part of the ink dots overlaps in a case where the striking positions are deviated within a tolerable error range for a discharge accuracy of the inkjet printer.

Further, as a configuration of the inkjet printer, for example, a configuration that performs printing by scanning the inkjet heads (main scan) in the predetermined main scanning direction can suitably be used. In this case, another one of the inkjet heads further discharging the ink droplet to the struck position of the ink by one of the inkjet heads may mean, for example, that a main scan by another one of the inkjet heads is performed on a region on the medium where a main scan by one of the inkjet heads has previously been performed.

(Configuration 2) The plurality of inkjet heads may respectively discharge the ink droplets to regions that are parts of the medium, the regions being at positions that are different in the moving direction. By configuring as above, for example, the timings at which the respective inkjet heads discharge the ink droplets onto the same position on the medium can suitably be offset. Further, due to this, for example, the ink dot formed by an ink droplet that has struck in advance can suitably be dried before the ink droplet of another color strikes the same position.

Further, in configuring as above, for example, a time by which the ink dot is spread to some extent can be spared to fix the ink on the medium. Due to this, by configuring as above, for example, the glossiness can appropriately be endowed to the printed object. Further, due to this, for example, the condition for preventing the smearing of the printed object and the condition for endowing the glossiness to the printed object can more appropriately be satisfied.

It should be noted that the plurality of inkjet heads respectively discharge ink droplets to the regions of which positions in the moving direction differ, for example by having their positions in the moving direction offset each other. Further, the plurality of inkjet heads may for example be arranged with their positions in the moving direction aligned. In this case, for example, the plurality of inkjet heads discharge the ink droplets to the regions of which positions in the moving direction differ by respectively discharging the ink droplets from a part of the nozzles in a nozzle row, and causing the positions of the nozzles selected for discharging the ink droplets to be different from each other.

(Configuration 3) As to a relationship of a heating temperature by the medium heating heater, an interval in the moving direction between the regions where the inkjet heads discharge the ink droplets, and a speed by which the opposing position changing unit relatively feeds the medium with respect to the inkjet heads, a condition may be set so that the ink that has been discharged from one of the inkjet heads and struck onto the medium is dried by the time when another one of the inkjet heads further discharges the ink droplet to the struck position of the ink.

In configuring as above, for example, among the ink to strike the same position on the medium, the ink that has struck in advance can suitably be fixed onto the medium before the subsequent ink strikes. Due to this, by configuring as above, for example, the generation of smears can more appropriately be suppressed. Further, also in this case, the time for allowing the ink dots before the fixation to spread can suitably be ensured for the plurality of inkjet heads. Due to this, by configuring as above, for example, the condition for preventing the smearing of the printed object and the condition for endowing the glossiness to the printed object can more appropriately be satisfied. It should be noted that, in a case of arranging the plurality of inkjet heads with their positions in the moving direction being offset, for example, the interval in the moving direction between the regions where the respective inkjet heads discharge ink droplets means an interval of the inkjet printer in the moving direction, for example.

(Configuration 4) The medium heating heater may heat the medium so that a maximum temperature of the medium is 70° C. or lower. The medium heating heater preferably heats the medium for example so that the temperature of the medium becomes 30° C. to 70° C. Further, the temperature of the heated medium is preferably 50° C. to 60° C.

In configuring as above, for example, the medium can be prevented suitably from excessively heating. Further, due to this, for example, problems caused by excessive heating such as drying of the inkjet heads and cockling of the medium can suitably be prevented. Due to this, by configuring as above, for example, the condition for preventing the smearing of the printed object and the condition for endowing the glossiness to the printed object can more appropriately be satisfied.

(Configuration 5) The plurality of inkjet heads may discharge the ink droplets onto the medium at positions that are different in the moving direction by being arranged with their positions in the moving direction being offset each other.

By configuring as above, for example, the timings by which the respective inkjet heads discharge the ink droplets to the same position on the medium can suitably be offset. Further, due to this, for example, the ink dot formed by the ink droplet that has struck in advance can more suitably be dried before an ink droplet of another color strikes the same position.

Further, in configuring as above, for example, a time by which the ink dot is spread to some extent can be spared before fixing the ink onto the medium. Due to this, by configuring as above, for example, the glossiness can more suitably be endowed to the printed object. Further, due to this, for example, the condition for preventing the smearing of the printed object and the condition for endowing the glossiness to the printed object can more appropriately be satisfied.

(Configuration 6) After an ink droplet discharged from one of the inkjet heads has struck onto a first striking position in the moving direction, the opposing position changing unit may cause a subsequent one of the inkjet heads adjacent to the one inkjet head in the moving direction to oppose the first striking position on the medium by relatively feeding the medium in the moving direction with respect to the plurality of inkjet heads, the subsequent inkjet head may discharge an ink droplet toward the first striking position in a state where the subsequent inkjet head opposes the first striking position, and the one inkjet head may discharge an ink droplet toward a second striking position of which position in the moving direction is different form the first striking position.

By configuring as above, for example, printing can suitably be performed at respective positions on the medium by the plurality of inkjet heads having their positions offset in the moving direction of the medium. Further, by using this specific configuration, for example, the condition for preventing the smearing of the printed object and the condition for endowing the glossiness to the printed object can more appropriately be satisfied.

(Configuration 7) A main-scan driving unit that causes each of the plurality of inkjet heads to perform a main scanning operation to discharge ink droplets while moving in a main scanning direction that vertically intersects the moving direction may further be included, wherein the opposing position changing unit may relatively feed the medium in the moving direction with respect to the plurality of inkjet heads in between the main scanning operations by the plurality of inkjet heads.

By configuring as above, for example, printing can suitably be performed at respective positions on the medium by the plurality of inkjet heads. Further, by using this specific configuration, for example, the condition for preventing the smearing of the printed object and the condition for endowing the glossiness to the printed object can more appropriately be satisfied.

It should be noted that, in this configuration, the moving direction of the medium is for example a sub scanning direction that vertically intersects the main scanning direction. Further, drying the ink that has been discharged from one of the inkjet heads and struck onto the medium before another inkjet head further discharges an ink droplet onto a struck position of the ink means for example that the ink is to be dried before another one of the inkjet heads performs the main scanning operation at the position in the sub scanning direction corresponding to this striking position.

(Configuration 8) The ink may be aqueous ink in which a main component of the solvent is water, or is solvent ink in which a main component of the solvent is organic solvent.

In using such ink, if plural types of ink are allowed to strike the same striking position before the solvent is sufficiently dried, smearing is more likely to occur. Further, if the ink is fixed onto the medium within a short period of time to suppress the smear generation, sufficient glossiness cannot be obtained. Further, if the medium heating heater is made hotter to fix the ink onto the medium within a short period of time, a problem caused by excessive heating may occur. Contrary to this, by configuring as above, for example, the condition for preventing the smearing of the printed object and the condition for endowing the glossiness to the printed object can more appropriately be satisfied even in the case of using such ink. Further, the heating temperature of the medium heating heater does not need to be set excessively high. Due to this, by configuring as above, for example, the high quality printing can more suitably be performed in the case of using the aqueous ink or solvent ink.

(Configuration 9) The ink may be latex ink. The latex ink is for example ink in which latex resin is dispersed in a solvent having water as its main component, and is ink for fixing a latex polymer material onto the medium by drying. The latex polymer material is for example a synthetic rubber-based polymer material.

Also in using such ink, smearing is more likely to occur if plural types of ink are allowed to strike the same striking position before the solvent is sufficiently dried. Further, if the ink is fixed onto the medium within a short period of time to suppress the smear generation, sufficient glossiness cannot be obtained. Further, if the medium heating heater is made hotter to fix the ink onto the medium within a short period of time, a problem caused by excessive heating may occur.

Contrary to this, by configuring as above, for example, the condition for preventing the smearing of the printed object and the condition for endowing the glossiness to the printed object can more appropriately be satisfied even in the case of using such ink. Further, the heating temperature of the medium heating heater does not need to be set excessively high. Due to this, by configuring as above, for example, high quality printing can more suitably be performed in the case of using the latex ink.

(Configuration 10) The ink may include a polymeric substance that is polymerized by ultraviolet ray irradiation and a solvent that dilutes the polymeric substance, the inkjet printer may further include an ultraviolet ray irradiation unit that delivers ultraviolet ray for curing the ink that has struck the medium, the medium heating heater may dry the ink in a state where curing by the ultraviolet ray irradiation has not yet been completed, and the ultraviolet ray irradiation unit may complete the curing of the ink by delivering the ultraviolet ray after the ink droplets has been discharged by the plurality of inkjet heads onto respective portions in the medium in the moving direction. The ink may for example be solvent UV ink that is ultraviolet ray curing type ink diluted by a solvent.

Also in using such ink, the solvent needs to be evaporated to fix the ink on the medium. Due to this, also in the case of using such ink, smearing is more likely to occur if plural types of ink are allowed to strike the same striking position before the solvent is sufficiently dried. Further, if the ink is fixed onto the medium within a short period of time to suppress the smear generation, sufficient glossiness cannot be obtained. Further, if the medium heating heater is made hotter to fix the ink onto the medium within a short period of time, a problem caused by excessive heating may occur.

Contrary to this, by configuring as above, for example, the condition for preventing the smearing of the printed object and the condition for endowing the glossiness to the printed object can more appropriately be satisfied even in the case of using such ink. Further, the heating temperature of the medium heating heater does not need to be set excessively high. Due to this, by configuring as above, for example, the high quality printing can more suitably be performed in the case of using the solvent UV ink.

It should be noted that the polymeric substance contained in ink is for example monomers or oligomers. Further, in this configuration, completing the curing of the ink means for example to cause the ink to achieve a certain hardened state that is set by design, using sufficient amount of ultraviolet ray irradiation. Further, the inkjet printer may further include an ultraviolet ray source for semi-curing the ink, in addition to the ultraviolet ray irradiation unit for completing the curing of the ink. Semi-curing the ink means for example delivering the ultraviolet ray to a degree by which viscosity of the ink is increased to assume a gel state.

(Configuration 11) A printing method for performing printing on a medium by an inkjet scheme, the printing method using: a plurality of inkjet heads that respectively discharge ink droplets of ink of different colors; a medium heating heater that heats the medium onto which the ink droplets have been discharged from the respective inkjet heads, by being arranged at a position opposing the plurality of inkjet heads with the medium intervened in between; and an opposing position changing unit that sequentially causes each position of the medium in a moving direction to oppose the respective inkjet heads, by feeding the medium in the moving direction that is predeterminedly and relatively set with respect to the plurality of inkjet heads, wherein the ink is ink that contains a solvent, and is fixed onto the medium by the solvent being dried, and the ink that has been discharged from one of the inkjet heads and struck onto the medium is dried by the medium heating heater by a time when another one of the inkjet heads further discharges an ink droplet to the struck position of the ink. By configuring as above, for example, an advantage similar to that of the configuration 1 can be obtained.

Effect of the Invention

According to the present invention, for example, the condition for preventing the smearing of the printed object and the condition for endowing the glossiness to the printed object can suitably be satisfied in the inkjet printer.

BRIEF DESCRIPTION OF THE DRAWINGS

FIG. 2A is a diagram showing states of an ink dot formed on the medium 50. FIG. 2B is a diagram showing an example of a state of a boundary between a dot 202*y* and a dot 202*m* in a case of having formed the dot 202*m* before the dot 202*y* is dried. FIG. 2C is a diagram showing an example of a state of the boundary between the dot 202*y* and the dot 202*m* in a case of having formed the dot 202*m* after the dot 202*y* has been dried.

EMBODIMENTS OF THE INVENTION

Figure 1:
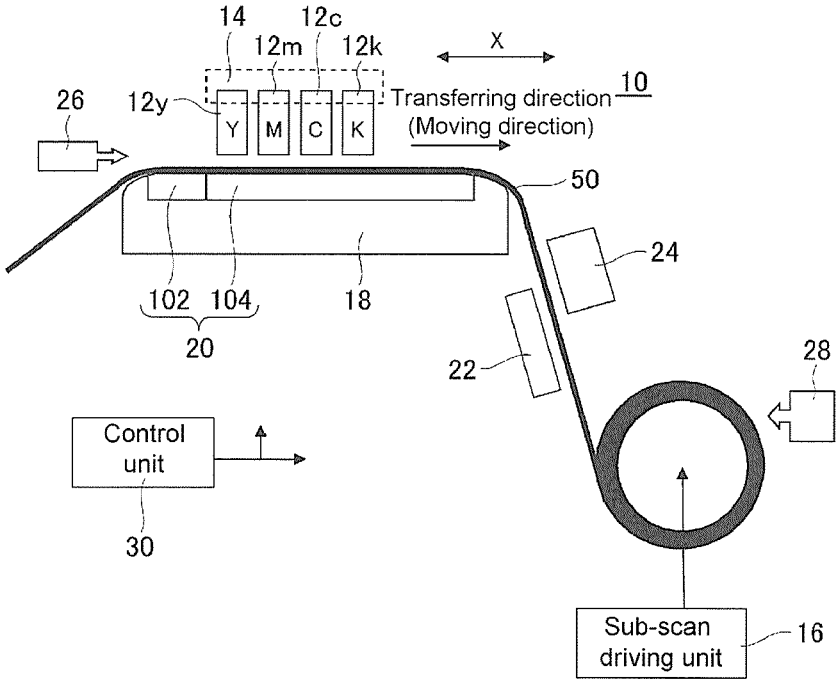
FIG. 1 is a diagram showing an example of a configuration of an inkjet printer 10 according to one embodiment of the present invention.

Hereinbelow, embodiments according to the present invention will be described with reference to the drawings. FIG. 1 is a diagram showing an example of a configuration of an inkjet printer 10 according to one embodiment of the present invention. The inkjet printer 10 is an inkjet printer that performs printing on a medium 50 using an inkjet scheme, and includes a plurality of inkjet heads 12*y*, 12*m*, 12*c*, 12*k* (hereinbelow denoted as inkjet heads 12*y-k*), a main-scan driving unit 14, a sub-scan driving unit 16, a platen 18, a platen heater 20, an after-heater 22, a warm/hot air heater 24, a dew condensation preventing fan 26, a cooling fan 28, and a control unit 30.

Further, in the present embodiment, the medium 50 is a roll-type medium. The inkjet printer 10 feeds out the medium 50 sequentially from a medium roll in which the medium 50 is rolled up onto the platen 18, and performs printing by the inkjet heads 12*y-k*. Further, the printed medium 50 is rolled up sequentially.

The plurality of inkjet heads 12*y-k* are inkjet heads that respectively discharge ink droplets of ink of different colors. The plurality of inkjet heads 12*y-k* discharge the ink droplets onto the medium 50 at positions that are different in a transferring direction, by being arranged having their positions relative to the transferring direction of the medium 50 offset each other. Due to this, the plurality of inkjet heads 12*y-k* respectively discharge the ink droplets to regions that are parts of the medium 50 with different positions in the transferring direction. Further, each of the plurality of inkjet heads 12*y-k* includes a nozzle row in which nozzles for discharging ink droplets are aligned. The nozzle row in each of the plurality of inkjet heads 12*y-k* may be a single row, or may be plural rows.

Further, in the present embodiment, the inkjet head 12*y* is an inkjet head for discharging yellow ink droplets. The inkjet head 12*m* is an inkjet head for discharging magenta ink droplets. The inkjet head 12*c* is an inkjet head for discharging cyan ink droplets. The inkjet head 12*k* is an inkjet head for discharging black ink droplets. The plurality of inkjet heads 12*y-k* are arranged in the depicted order in the transferring direction of the medium 50 so that they discharge the ink droplets onto the respective positions of the medium 50 in the order of yellow, magenta, cyan, and black. In a modification of the inkjet printer 10, the inkjet printer 10 may further include an inkjet head that discharges ink droplets of yet another color.

It should be noted that the transferring direction of the medium is an example of a moving direction along which the medium 50 is relatively fed with respect to the plurality of inkjet heads 12*y-k*, and is for example set in advance as a predetermined sub scanning direction (X direction in the drawings). Further, in the present embodiment, the plurality of inkjet heads 12*y-k* are arranged separate from each other in the transferring direction. A relationship of the arrangement of the plurality of inkjet heads 12*y-k* and the like and a printing operation will be described later in detail.

The main-scan driving unit 14 is a configuration for causing the plurality of inkjet heads 12*y-k* to perform a main scanning operation, and is configured for example of a carriage, a guide rail, and the like. In this case, the carriage retains the plurality of inkjet heads 12*y-k* by making them oppose the medium 50. The guide rail guides a movement of the carriage in a predetermined main scanning direction.

Further, due to this, the plurality of inkjet heads 12*y-k* perform a main scanning operation of discharging ink droplets toward the medium 50 while moving in the main scanning direction.

It should be noted that, in the present embodiment, the main scanning direction is a direction vertically intersecting the sub scanning direction shown as the X direction in the drawings. Further, the plurality of inkjet heads 12*y-k* discharge ink droplets in both of an outgoing pass and an incoming pass that transverse the medium 50 by moving in the main scanning direction.

The sub-scan driving unit 16 is a configuration for transferring the medium 50 in the sub scanning direction. In the present embodiment, the sub-scan driving unit 16 is a driving unit that causes a roller for rolling up the medium 50 after printing by the inkjet heads 12*y-k* to rotate, and moves the medium 50 in the sub scanning direction by causing the roller to roll up the medium 50. Due to this, the sub-scan driving unit 16 transfers the medium 50 in the sub scanning direction as its transferring direction.

Further, the sub-scan driving unit 16 performs a sub scanning operation of transferring the medium 50 in the sub scanning direction in between the main scanning operations by the plurality of inkjet heads 12*y-k*. Due to this, the sub-scan driving unit 16 sequentially causes the respective positions of the medium 50 in the sub scanning direction to oppose the respective one of the plurality of inkjet heads 12*y-k*.

It should be noted that, in the present embodiment, the sub-scan driving unit 16 is an example of an opposing position changing unit. The sub-scan driving unit 16 relatively feeds the medium in the sub scanning direction with respect to the plurality of inkjet heads 12*y-k* by transferring the medium 50, and sequentially causes the respective positions of the medium 50 in the sub scanning direction to oppose the respective one of the plurality of inkjet heads 12*y-k*. Further, in a modification of the configuration of the inkjet printer 10, a configuration that transfers the medium 50 in a method different from the present embodiment may be used as the opposing position changing unit. Further, the opposing position changing unit may move the inkjet heads 12*y-k* side with respect to the medium 50 of which position is fixed.

The platen 18 is a stage for retaining the medium 50 by causing it to oppose the plurality of inkjet heads 12*y-k*. The platen heater 20 is a heater arranged at a position of the platen 18. In the present embodiment, the platen heater 20 includes a pre-heater 102 and a print heater 104.

The preheater 102 is a heater that is arranged at an upstream side position from any of the plurality of inkjet heads 12*y-k*, and heats the medium 50 at an upstream position from where the ink droplets are to be discharged by the plurality of inkjet heads 12*y-k*. The print heater 104 is an example of a medium heating heater, and heats the medium 50 onto which the ink droplets has been discharged from the inkjet heads 12*y-k*, by being arranged at the position opposing the plurality of inkjet heads 12*y-k* with the medium 50 intervened in between.

Further, in the present embodiment, the pre-heater 102 and the print heater 104 heat the medium 50 such that a maximum temperature of the medium 50 is 70° C. or lower. The temperature of the heated medium 50 is for example 30° C. to 70° C., and more preferably 50° C. to 60° C. By configuring as above, for example, excessive heating of the medium 50 can suitably be prevented. Further, due to this, for example, problems caused by excessive heating such as drying of the inkjet heads 12*y-k* and cockling of the medium and the like can suitably be prevented.

It should be noted that each of the pre-heater 102 and the print heater 104 may be a part of one heater. Further, as to the heating temperature of the medium 50, it will be described later in further detail together with the relationship between the arrangement of the plurality of inkjet heads 12*y-k* and the printing operation.

The after-heater 22 and the warm/hot air heater 24 are heaters provided on a downstream side from the inkjet heads 12*y-k* in the transferring direction of the medium 50, and heat the medium 50 after printing by the plurality of inkjet heads 12*y-k*. In the present embodiment, the after-heater 22 heats the medium 50 from a back surface side of a printed surface of the medium 50. Further, the warm/hot air heater 24 heats the medium 50 by blowing warm/hot air onto the printed surface of the medium 50. According to this embodiment, for example, the medium 50 can be heated by taking time as needed. Further, due to this, for example, the heating temperature by the platen heater 20 can be suppressed.

The dew condensation preventing fan 26 is a fan for dew condensation prevention in the inkjet heads 12*y-k*, and sends air as needed to a region between the inkjet heads 12*y-k* and the medium 50. The cooling fan 28 is a fan for cooling the medium 50 before rolling the printed medium 50 up in the form of a roll. The cooling fan 28 lowers the temperature of the medium 50 by sending air onto the medium 50 heated by the platen heater 20 and the like.

Here, depending on a material of the medium 50, viscosity of the medium 50 in some cases becomes high when the temperature is high. Further, as a result, in the case of rolling up the printed medium 50 in the form of a roll, it becomes difficult in some cases to appropriately roll it up. Contrary to this, according to this embodiment, the medium 50 before the roll-up can suitably be cooled. Further, due to this, an occurrence of a problem upon the roll-up caused by the viscosity of the medium 50 can suitably be prevented.

The control unit 30 is for example a CPU of the inkjet printer 10, and controls operations of respective units of the inkjet printer 10. According to this embodiment, suitable printing can be performed by the inkjet heads 12*y-k* on the respective portions of the medium 50.

Next, ink used in the inkjet printer 10 of the present embodiment will be described. In the present embodiment, the ink of the respective colors as used in the inkjet printer 10 is solvent-containing ink, and is fixed onto the medium by drying the solvent. More specifically, the ink for example is aqueous ink in which a main component of the solvent is water, or solvent ink in which a main component of the solvent is an organic solvent.

It should be noted that the solvent ink is for example ink in which a color material such as a pigment is dispersed by the organic solvent instead of water. As the solvent of the solvent ink, for example, either a high solvent (real solvent) or a low solvent (eco solvent) can be used. Solvent ink that uses the high solvent is for example solvent ink that uses a volatile organic solvent. Further, solvent ink that uses the low solvent is for example solvent ink that does not contain environmental load substances.

Figure 2A:
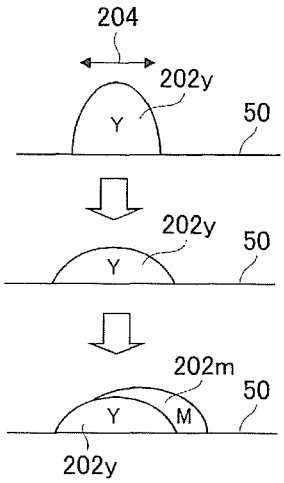
FIG. 2A to FIG. 2C are diagrams explaining ink dots formed on a medium 50 by ink droplet discharge.
Figure 2B:
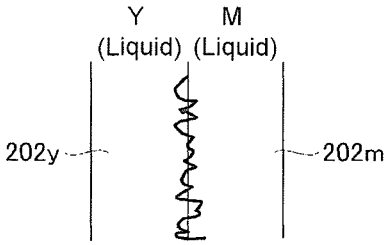
Figure 2C:
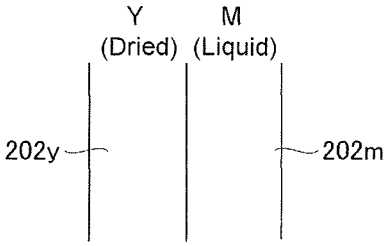

FIG. 2A to FIG. 2C are diagrams explaining the ink dots formed on the medium 50 by ink droplet discharge. FIG. 2A is a diagram showing a state of the ink dot formed on the medium 50, showing an example in which an ink dot 202*y* is formed initially by the inkjet head 12*y* (see FIG. 1) and an ink dot 202*m* is formed by the inkjet head 12*m* (see FIG. 1) at a position overlapping the dot 202*y*.

When the ink droplet discharged from the inkjet head 12*y* strikes the medium 50, the ink dot 202*y* is thereby formed. Further, thereafter a diameter of the dot 202*y* gradually expands as shown by an arrow 204, in accordance with progression of leveling over time. Further, when the inkjet head 12*m* further discharges an ink droplet to the position overlapping the dot 202*y*, the dot 202*m* by the ink droplet discharged from the inkjet head 12*m* is formed by overlapping the dot 202*y*.

However, for example, if the dot 202*m* is formed when the dot 202*y* is in a state of liquid before being dried, the ink is mixed at a boundary thereof, and smearing might occur. FIG. 2B is a diagram showing an example of a state of a boundary between a dot 202*y* and a dot 202*m* in a case of having formed the dot 202*m* before the dot 202*y* is dried. As shown in the drawing, if the dot 202*y* and the dot 202*m* both of which are in the liquid state make contact, bleeding (Brownian movement) at the boundary of the ink of different colors causes the ink to mix. Further, as a result, the smearing (intercolor smearing) will occur.

To suppress such smearing, it is effective to dry the dot 202*y* before forming the dot 202*m*. FIG. 2C is a diagram showing an example of a state of the boundary between the dot 202*y* and the dot 202*m* in a case of having formed the dot 202*m* after the dot 202*y* has been dried. In this case, since the dot 202*y* on one side is dried, bleeding does not occur even in the event of making contact with the dot 202*m* being in the liquid state. Further, as a result, no smear will be generated.

Due to this, in thinking from the point of view to suppress the ink smearing, as the configuration of the inkjet printer 10, it may seem preferable to dry the ink dot formed by each of the inkjet heads 12*y-k* (see FIG. 1) as soon as possible. However, in order to perform high quality printing, not only the smearing of the printed object needs to be prevented, but also endowing glossiness to the printed object and the like also needs to be taken into consideration. Further, to endow glossiness to the printed object, the ink needs to be dried after waiting for the ink dot to spread to some degree. Further, in order to dry the ink under a practical condition, printing speed and heating temperature of the medium 50 and the like also needs to be taken into consideration. Further, when these points are taken into consideration, there are cases where it is difficult to more suitably satisfy both the condition for preventing the smearing of the printed object and the condition for endowing the glossiness to the printed object. Thus, subsequently, the condition for preventing the smearing of the printed object and the condition for endowing the glossiness to the printed object will be described.

Figure 3:
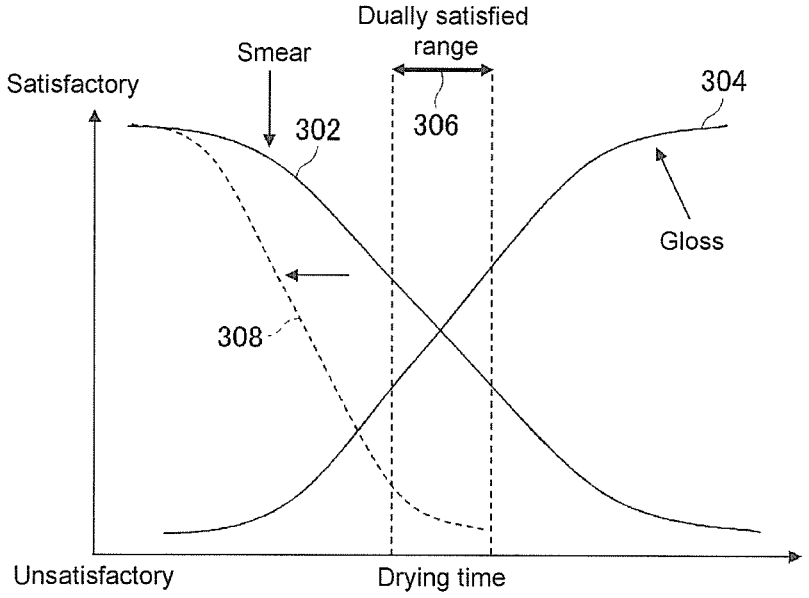
FIG. 3 is a graph showing an example of a relationship between a time until an ink dot is dried, and smearing and glossiness of a printed object.

FIG. 3 is a graph showing an example of the relationship between the time until the ink dot is dried, and the smearing and glossiness of the printed object. The time required until the dot is dried (drying time) is a time required until the ink dot by the ink droplet discharged on the medium is fixed onto the medium. Further, the ink dot being fixed onto the medium means that the solvent within the ink has sufficiently evaporated and the ink comes to be in a dried state.

It should be noted that, in this graph, a curve showing a state of smearing of the printed object is a result for a case where a conventionally known, general inkjet printer is used instead of the inkjet printer 10 of the present embodiment as described using FIG. 1 and the like. The conventionally known, general inkjet printer is for example an inkjet printer having a configuration in which plural types of inkjet heads for respectively discharging ink of different colors are aligned in the main scanning direction.

In the graph, a solid line 302 is a curve showing a relationship of the state of smear generated in the printed object and the drying time. As can be understood from this curve, smearing is less likely to occur with short drying time, and a satisfactory printing result can be obtained in regards to the smearing. However, when the drying time becomes longer, the smearing more frequently occurs, as a result of which the printing result is deteriorated. This is because when the time during which the ink remains in the liquid state is elongated, time during which the ink mixing progresses becomes longer for example at a region where the dots by ink of different colors overlap. Due to this, the drying time needs to be made short to sufficiently suppress the ink smearing.

Further, in the graph, a solid line 304 is a curve showing a relationship of the state of gloss endowed to the printed object and the drying time. As can be understood from this curve, the glossiness is increased with sufficiently elongated drying time, and a satisfactory glossiness can be obtained. This is because the ink dot is sufficiently spread by the time when the ink is dried. However, when the drying time is too short, sufficient glossiness cannot be achieved. This is because with the short drying time, the drying is completed before the ink dot is sufficiently spread, whereby smoothness (flatness) of the ink dot becomes insufficient. Due to this, in order to endow sufficient glossiness to the printed object, the drying time needs to be elongated.

As above, in the case of using the solvent-containing ink in the inkjet printer, the condition for preventing the smearing of the printed object and the condition for endowing the glossiness to the printed object are in a trade-off relationship. Due to this, a range by which both conditions are practically sufficiently met is in a narrow certain range as shown for example in the graph by an arrow 306.

However, the inventor of the present application has found, as a result of his keen study, that there are cases with the inkjet printer with the conventional configuration in which the range where both of the conditions are practically sufficiently met cannot be obtained, depending on the condition of printing, for example. For example, in a case where the printing speed is made fast, the ink dots need to be dried at a shorter drying time. Further, in this case, there are cases where the dots need to be dried in a drying time that is even shorter than the range indicated by the arrow 306 in the drawing. Due to this, in such a case, it becomes difficult to suitably satisfy the condition for preventing the smearing of the printed object and the condition for endowing the glossiness to the printed object.

Further, for example, depending on the print condition, there are cases where ink smearing is more likely to occur. More specifically, for example, when the printing speed is made fast, an amount of the ink discharged per a unit time is increased, in which case the ink smearing is more likely to occur. Further, in a case of performing printing at a higher resolution, ink dots needs to be formed in narrower regions, in which case the ink smearing is more likely to occur. Further, for example, if the temperature of the heater cannot be increased, an amount of evaporation on the medium within the same drying time becomes less, in which case the ink smearing is more likely to occur.

Further, in these cases, a curve indicating the state of the smearing of the printed object shifts leftward in the graph from the curve shown by the solid line 302, and for example becomes as a curve shown by a broken line 308. In this case, the glossiness would not be enough if the drying time that can sufficiently suppress the smearing is employed, and the smearing would become problematic if the drying time for sufficiently endowing the glossiness is employed. Due to this, also in such a case, it becomes difficult to suitably satisfy both the condition for preventing the smearing of the printed object and the condition for endowing the glossiness to the printed object.

Contrary to this, according to the inkjet printer 10 of the present embodiment as explained with reference to FIG. 1 and the like, the condition for preventing the smearing of the printed object and the condition for endowing the glossiness to the printed object can suitably be satisfied even in such a case. Thus, hereinbelow, this feature will be described in detail.

Figure 4:
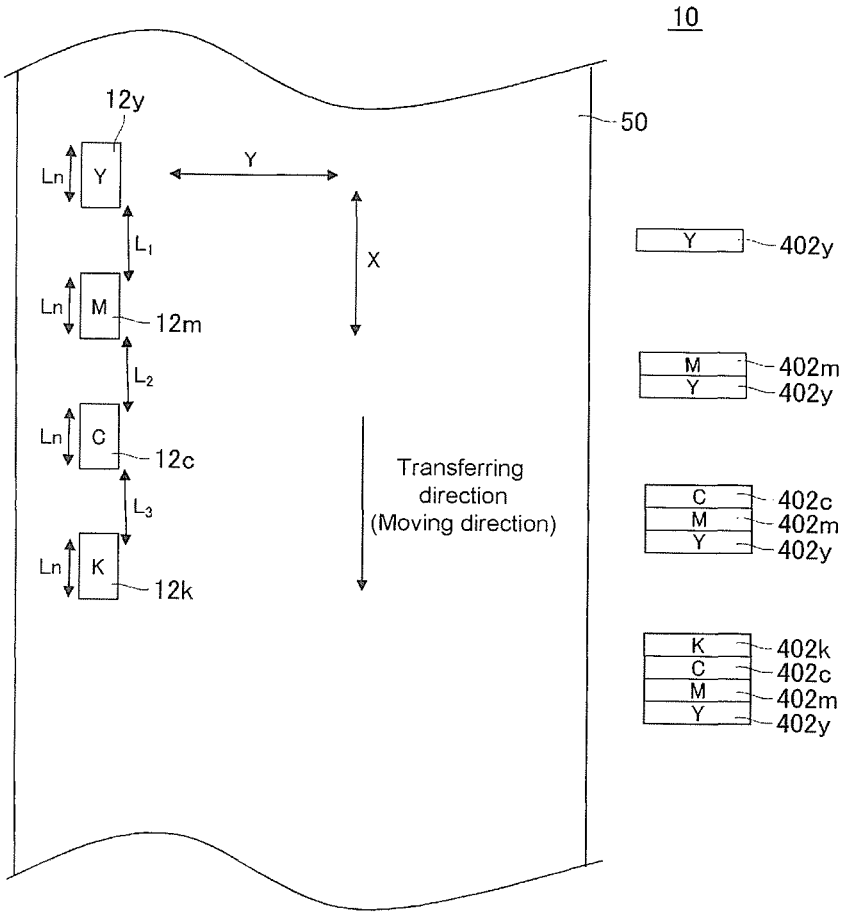
FIG. 4 is a diagram explaining a relationship of arrangements and the like of a plurality of inkjet heads 12*y*, 12*m*, 12*c*, 12*k* of the inkjet printer 10 of the present embodiment and a printing operation.

FIG. 4 is a diagram explaining a relationship of arrangements and the like of the plurality of inkjet heads 12*y-k* of the inkjet printer 10 of the present embodiment and the printing operation. As described with reference to FIG. 1 and the like, in the present embodiment, the plurality of inkjet heads 12*y-k* are arranged by aligning in the sub scanning direction that is parallel to the transferring direction (moving direction) of the medium 50.

Further, in the present embodiment, the plurality of inkjet heads 12*y-k* do not just simply align in the sub scanning direction, but are also arranged along the sub scanning direction with intervals in between. For example, as shown in the drawings, the plurality of inkjet heads 12*y-k* are arranged along the sub scanning direction by being apart from one another by distances L1, L2, L3, respectively.

In the case of performing printing using the inkjet heads 12*y-k* with such a configuration, the respective portions of the medium 50 sequentially oppose the respective one of the inkjet heads 12*y-k*. Further, due to this, the ink droplets are sequentially discharged by the respective one of the inkjet heads 12*y-k* onto the respective portions of the medium 50. More specifically, for example, by being sequentially transferred in the transferring direction by the sub scanning operations, the respective portions of the medium 50 firstly oppose the inkjet head 12*y* being the inkjet head that is on the uppermost stream side in the transferring direction. Further, the inkjet head 12*y* discharges the ink droplets by the main scanning operation onto the region within the medium 50 being opposed. Due to this, as shown on a right side in the drawing, a layer 402*y* in which yellow ink dots align is formed in this region within the medium 50.

Further, thereafter the region in which the layer 402*y* has been formed is then opposed to the inkjet head 12*m* by the medium 50 being further transferred by the sub scanning operation. Further, the inkjet head 12*m* discharges ink droplets onto this region by the main scanning operation. Due to this, as shown on the right side in the drawing, a layer 402*m* in which magenta ink dots align is formed in this region within the medium 50 over the layer 402*y*.

Further, this region is then opposed sequentially to the inkjet heads 12*c*, 12*k* by the sub scanning operations that take place thereafter. Further, a layer 402*c* in which cyan ink dots align is formed over the layer 402*y* and layer 402*m* by the main scanning operation by the inkjet head 12*c*. Further, by the main scanning operation by the inkjet head 12*k*, a layer 402*k* in which black ink dots align is formed over the layer 402*y*, layer 402*m*, and layer 402*c*. Accordingly, after having passed through the positions opposing respective ones of the inkjet heads 12*c-k*, respective single color layers (layers) of a plurality of colors are sequentially formed on the medium 50.

Here, in the present embodiment, the plurality of inkjet heads 12*y-k* perform the main scanning operations at the same time. Due to this, each of the plurality of inkjet heads 12*y-k* discharges the ink droplets onto a corresponding region on the medium 50 at different positions in the sub scanning direction. That is, for example, in a case where the ink droplets discharged by the inkjet head 12*y* by the main scanning operation has struck a first striking position, thereafter the sub-scan driving unit 16 (see FIG. 1) transfers the medium 50 so that the first striking position of the medium 50 is caused to oppose the inkjet head 12*m* adjacent to the inkjet head 12*y* in the sub scanning direction. Further, in this state, the inkjet head 12*m* discharges ink droplets toward the first striking position by the main scanning operation. Further, at the same e, the inkjet head 12*y* performs the main scanning operation in another region within the medium 50, and discharges ink droplets toward a second striking position, of which position in the sub scanning direction is different from the first striking position. According to the present embodiment, for example, printing can suitably be performed at the respective positions on the medium 50 by the plurality of inkjet heads 12*y-k* having their positions offset in the sub scanning direction.

Further, in the present embodiment, timings at which the inkjet heads 12*y-k* respectively discharge the ink droplets onto the same position within the medium 50 is offset each other by arranging the plurality of inkjet heads 12*y-k* with their positions in the sub scanning direction offset one another. More specifically, for example, in the case where the inkjet head 12*y* has discharged the ink droplets onto a particular region within the medium 50, the ink dots formed in this region contain only the yellow ink dots by the time when this region moves to the position for opposing the inkjet head 12*m* and the main scanning operation by the inkjet head 12*m* is performed. Due to this, in this period, the smearing caused by the ink of different colors being mixed does not occur.

Further, during this period, since no ink smearing will be generated, the ink does not need to be dried in a hurry. Due to this, the print heater 104 (see FIG. 1) simply needs to dry the ink dots formed of the yellow ink by the time when the inkjet head 12*m* further discharges the ink droplets onto that position. By configuring as above, for example, another ink can appropriately be prevented from further striking onto the position of the ink that has not yet been dried. Further, due to this, the ink smearing can appropriately be suppressed.

Further, in this case, for example, the time by which the ink dot is spread to some extent can be spared before fixing the ink on the medium. Due to this, by configuring as above, for example, the glossiness can appropriately be endowed to the printed object. Further, due to this, for example, the condition for preventing the smearing of the printed object and the condition for endowing the glossiness to the printed object can appropriately be satisfied.

Further, these features apply similarly to sequences after the ink droplet discharge by the inkjet heads 12*m*, 12*c*, 12*k*. Also in such cases, the condition for preventing the smearing of the printed object and the condition for endowing the glossiness to the printed object can suitably be satisfied by drying the ink dots formed respectively by one of the inkjet heads 12 by the time when the ink droplets are discharged by the next one of the inkjet heads.

Further, in the present embodiment, the ink can be dried by taking some time as above. Due to this, the heating temperature of the medium 50 by the print heater 104 and the like can be suppressed to a low temperature. For example, as described with reference to FIG. 1, in the present embodiment, the pre-heater 102 and the print heater 104 heat the medium 50 so that the maximum temperature of the medium 50 becomes 70° C. or lower. Further, the heating temperature of the medium 50 may be set to 50° C. to 60° C. Furthermore, the heating temperature of the medium 50 may be about 50° C. or lower (for example, 45° C. to 50° C.). By configuring as above, for example, the glossiness can be increased by taking more time to dry the ink. Further, the nozzles of the inkjet head 12*y*-*k* can suitably be prevented from being dried. Moreover, even in a case of using a medium 50 with low heat durability such as vinyl chloride or the like, the cockling and the like can be prevented, and printing can more suitably be performed.

Further, as described with reference to FIG. 1, in the present embodiment, the inkjet printer 10 includes the platen heater 20, after-heater 22, and warm/hot air heater 24 as its heater (see FIG. 1). Further, the platen heater 20 is configured of the pre-heater 102 and print heater 104. Further, by using such a configuration, according to this embodiment, the temperature of the medium 50 can suitably be prevented from being excessively high.

For example, as described in the above, in the present embodiment, no ink smearing is generated even if the drying time is lengthened to some extent. Due to this, the temperature of the print heater 104 arranged at the position opposing the inkjet heads 12*y*-*k* can be set to a low temperature within a range by which the cockling and the like can be prevented. However, if the temperature of the print heater 104 is low, a rising speed of the temperature of the medium 50 becomes slow, and it might become difficult to perform suitable heating within a required time. Contrary to this, in the present embodiment, the medium 50 is preheated by the pre-heater 102 on the upstream side in the transferring direction from the print heater 104. Due to this, according to this embodiment, the medium 50 can more appropriately be heated even in the case of using a low-temperature print heater 104.

Further, in the present embodiment, the after-heater 22 and the warm/hot air heater 24 are further provided on the downstream side in the transferring direction from the print heater 104. Due to this, the ink only needs to be dried sufficiently within a range by which the purpose of preventing the ink smearing can be achieved at the position of the print heater 104, and it is not necessarily required to dry the same to a level that is required in a case of considering the roll-up operation after printing and influences upon storage, for example. For example, with the print heater 104, only surfaces of the ink dots may be dried. Also in this case also, sufficient drying can be performed by taking time at the positions of the after-heater 22 and the warm/hot air heater 24, as compared for example to a case of heating the medium 50 only by the platen heater 20.

Due to this, according to this embodiment, the heating temperature by the print heater 104 and the like can more appropriately be suppressed. Further, due to this, the problem caused by the heating of the medium 50 can more suitably be prevented.

Here, as is apparent from the above description and the like, in the present embodiment, the relationship among the heating temperature by the print heater 104, the intervals in the alignment of the inkjet heads 12*y*-*k* in the sub scanning direction (distances L1, L2, L3), and the transferring speed of the medium 50 is set according to a degree of the ink drying time. Further, this relationship is set for example to the condition by which the ink that has been discharged from one inkjet head among the inkjet heads 12*y*-*k* and struck onto the medium is dried before another inkjet head further discharges an ink droplet onto the struck position of the ink. By configuring as above, for example, the condition for preventing the smearing of the printed object and the condition for endowing the glossiness to the printed object can more appropriately be satisfied.

Further, more specifically, the distances L1, L2, L3 being the intervals of the alignment of the inkjet heads 12*y*-*k* are preferably distances that are equal to or more than lengths in the sub scanning direction (hereafter referred to as main scanning widths) of regions where printing is to be performed by one main scanning operation of the respective inkjet heads 12*y*-*k*, for example. These main scanning widths are widths that oppose lengths of the nozzle rows in the sub scanning direction of the inkjet heads 12*y*-*k*, for example. For example, in assuming that the main scanning widths of the inkjet heads 12*y*-*k* are Ln, then L1, L2, and L3 are preferably distances that are equal to or more than Ln.

In configuring as above, for example, the time period from when an ink layer of one color has been formed in the respective positions of the medium 50 until when the ink droplets of another color are discharged to that position is a time that has one or more main scanning operations intervened in between. Due to this, by configuring as above, for example, the time to dry the ink can more appropriately be ensured. Further, due to this, even in a case where the heating temperature by the print heater 104 and the like is suppressed, the ink can be dried more appropriately. Further, L1, L2, and L3 may be distances that are twice or more than Ln. By configuring as above, for example, the time to dry the ink can more appropriately be ensured.

It should be noted that the distances L1, L2, L3 may for example be distances between substantial portions that discharge the ink droplets in the plurality of inkjet heads 12*y-k*. The substantial portions of the inkjet heads 12*y-k* for example mean portions of the nozzle rows where the ink droplets are discharged. That is, these distances L1, L2, L3 may be distances between nozzle rows of the inkjet heads 12*y-k*. Further, the distances L1, L2, L3 may be an identical distance.

As above, in the present embodiment, the condition of the smear prevention in the printed object and the condition for endowing the glossiness to the printed object, which are in the trade-off relationship with each other, and of which dual satisfaction has been difficult, can both be satisfied by employing the configuration of laminating the single color layers that are formed by offsetting the timings. Specifically, in the case of using ink that uses a solvent, the layers formed by the main scanning operation at the respective positions of the medium 50 are formed only of single color layers. In this case, the problem of the intercolor smearing does not occur even if the ink among the dots mixes, due to the mixture of the same color. Further, in this case, since the smearing is not generated even if time is required for drying, for example, printing can appropriately be performed even if ink that takes long time to dry is used. Further, by causing the main scanning operations to be performed at the same time at different positions in the sub scanning direction by using the plurality of inkjet heads 12*y-k* that respectively discharge the ink of different colors, the ink droplets of the respective colors can be discharged onto the respective positions of the medium 50, with a certain time delay. Due to this, according to this embodiment, the printing time will not be elongated such as in a case of using a method of surface sequential printing.

Further, in the present embodiment, the medium heating temperature can be suppressed, since the drying time for the ink can suitably be ensured even in the case of performing printing at high speed, for example, by using the plurality of inkjet heads 12*y-k* arranged with their positions offset in the sub scanning direction. That is, in the present embodiment, the time from when the ink droplets to be a lower layer have struck until the ink droplets to be an upper layer, which is of a color different from that of the lower layer, strike can be lengthened. Due to this, for example, the heating temperature of the print heater 104 can be set to a low temperature. Further, due to this, a surface of the lower layer can be dried by sufficiently securing the drying time for the ink to dry up. Further, by a mutual effect of the use of the ink that uses solvents and the lengthening of the drying time by keeping a drying temperature low, the ink dots in the lower layer can sufficiently be flattened (smoothed) to provide glossiness. Further, in the present embodiment, the ink dots are flattened for each color, in a state where ink dots of another color is to be formed thereon. Due to this, according to this embodiment, the ink dots can more suitably be flattened (leveled). Further, due to this, high glossiness can more suitably be provided.

Further, as to the configuration of the present embodiment, for example, it can be said to be a configuration that prevents the smearing and enables high speed printing, even in the case where the temperature of the print heater 104 and the like is made even lower. Due to this, the configuration of the inkjet printer 10 of the present embodiment can be said to be especially preferable for example for cases of using ink by which drying of the nozzles is likely to occur (for example, solvent ink), or for cases of using a medium 50 with low heat durability (for example, vinyl chloride medium).

Moreover, in the present embodiment, how the ink of different colors are overlapped is not dependent on the moving direction of the inkjet heads 12*y-k* in the main scanning operations. That is, for example, in a case of a configuration in which a plurality of inkjet heads is aligned in the main scanning direction, as in the configuration of the conventional inkjet printer, how the ink of the respective colors overlaps differs depending on which timing, among the outgoing pass and the incoming pass that transverse the medium 50, in the main scanning operations. Further, as a result, a difference might be generated in color reproducibility depending on being of the outgoing pass or the incoming pass.

Contrary to this, in the present embodiment, the ink droplets to be discharged upon the main scan are of only one type (one color) at each position of the medium 50. Due to this, even if the ink droplets are discharged in both of the outgoing pass and the incoming pass, there would be no difference generated in the color reproducibility. Accordingly, according to this embodiment, further, stable color reproducibility can suitably be realized.

As above, according to this embodiment, the high quality printing can more suitably be performed by the solvent-containing ink. Further, in the above, it has been described to use the aqueous ink or solvent ink as the solvent-containing ink, for example. However, according to the inkjet printer 10 of the present embodiment, a similar effect can be achieved even in a case of using other ink. For example, latex ink may be considered to be used in the inkjet printer 10 having the same or similar configuration as that described with reference to FIG. 1 to FIG. 4. The latex ink is for example ink in which latex resin is dispersed in a solvent having water as its main component, and is ink for fixing a latex polymer material onto the medium by drying. The latex polymer material is for example a synthetic rubber-based polymer material.

Also in this case, for example, the condition for preventing the smearing of the printed object and the condition for endowing the glossiness to the printed object can more appropriately be satisfied due to the same reason as the cases of using the aqueous ink or solvent ink. Further, the heating temperature of the medium heating heater does not need to be set excessively high. Due to this, for example, the high quality printing can more suitably be performed in the case of using the latex ink.

Further, for example, by causing the configuration of the inkjet printer 10 to differ partially, solvent UV ink and the like for example may suitably be used as the solvent-containing ink. The solvent UV ink is UV ink diluted by a solvent, and for example, it contains a polymeric substance that is polymerized by ultraviolet ray irradiation, and a solvent that dilutes the polymeric substance. This polymeric substance is for example a monomer or an oligomer. Further, the solvent of the solvent UV ink is for example an organic solvent. This organic solvent may for example be a volatile organic solvent. This organic solvent may for example be an organic solvent having a boiling point lower than water.

Figure 5:
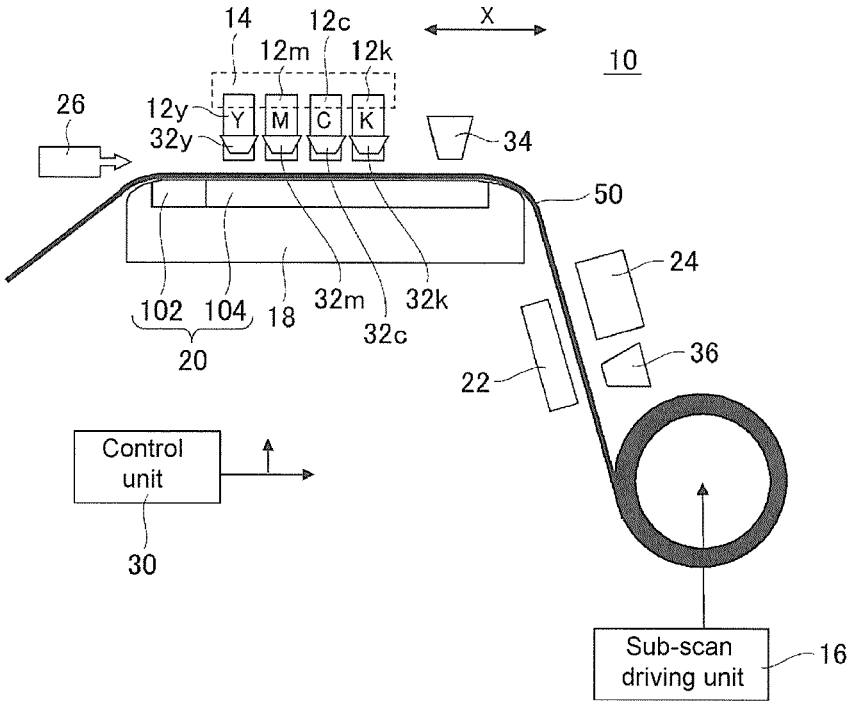
FIG. 5 is a diagram showing an example of a configuration of the inkjet printer 10 in a case of using solvent UV ink.

FIG. 5 is a diagram showing an example of a configuration of the inkjet printer 10 in the case of using the solvent UV ink. It should be noted that, except for the points described below, the configurations given the same reference signs in FIG. 5 as those of FIG. 1 to FIG. 4 have the same or similar features as the configurations of FIG. 1 to FIG. 4. Further, in the configuration shown in FIG. 5, the cooling fan 28 (see FIG. 1) is omitted as compared to the configuration shown in FIG. 1. However, also in the configuration shown in FIG. 5, the cooling fan 28 may further be provided.

In the present embodiment, the inkjet printer 10 includes the plurality of inkjet heads 12*y-k*, the main-scan driving unit 14, the sub-scan driving unit 16, the platen 18, the platen heater 20, the after-heater 22, the warm/hot air heater 24, the dew condensation preventing fan 26, the control unit 30, a plurality of weak ultraviolet ray sources 32*y*, 32*m*, 32*c*, 32*k* (hereafter referred to as weak UV sources 32*y-k*), an intense ultraviolet ray source 34, and an ultraviolet ray source 36. Further, the platen heater 20 includes the pre-heater 102 and the print heater 104.

Further, in the present embodiment, the plurality of inkjet heads 12*y-k* are inkjet heads for discharging the solvent UV ink. Further, the print heater 104 being an example of the medium heating heater dries the ink in the state where its curing by the ultraviolet ray irradiation has not yet been completed.

Further, as compared to the inkjet printer 10 shown in FIG. 1 and the like, the inkjet printer 10 of the present embodiment further includes the plurality of weak UV sources 32*y-k* and the ultraviolet ray source 36. The plurality of weak UV sources 32*y-k* are ultraviolet ray sources that emit weak ultraviolet ray that cannot completely cure the ink. Each of the plurality of weak UV sources 32*y-k* is arranged at a position adjacent to the corresponding one of the plurality of inkjet heads 12*y-k* in the main scanning direction, and moves together with the plurality of inkjet heads 12*y-k* upon the main scan, and delivers the ultraviolet ray onto the ink that has struck the medium 50. Due to this, the plurality of weak UV sources 32*y-k* increase the viscosity of the ink just after the striking, and causes the ink to be in a semi-cured state. By configuring as above, for example, the plurality of ink layers can more suitably be laminated in the case of further laying the ink layers of different colors at a later stage.

It should be noted that, as the UV sources 36*y-k*, for example, UV LEDs may suitably be used. By configuring as above, the UV sources 36*y-k* can more suitably be made compact. Further, due to this, for example, the UV sources 36*y-k* can suitably be arranged in the vicinity of the inkjet heads 12*y-k*.

Further, the semi-cured state is for example a state in which the ink has turned into a gel form. In this state, for example, the ink has not yet been cured completely, and is in the state where the flattening (leveling) progresses for a while at least after the ultraviolet ray irradiation. Further, depending on the ink property, the weak UV sources 32*y-k* may be omitted. For example, in the case where the viscosity of the ink in the state where the solvent component has been evaporated by the platen heater 20 can be made sufficiently high, the weak UV sources 32*y-k* may be omitted.

The intense ultraviolet ray source 34 and the ultraviolet ray source 36 are examples of the ultraviolet ray irradiation unit that delivers the ultraviolet ray for curing the ink that has struck the medium 50. The intense ultraviolet ray source 34 and the ultraviolet ray source 36 are arranged on the downstream side of the plurality of inkjet heads 12*y-k* in the transferring direction of the medium 50, and completes the curing of the ink by delivering sufficient amount of ultraviolet ray onto the medium 50. Completing the curing of the ink means causing the ink to reach the hardened state as defined by the design and the like by the sufficient amount of ultraviolet ray irradiation, for example.

It should be noted that, in the present embodiment the curing of the ink is completed by using a plurality of sources (intense ultraviolet ray source 34 and ultraviolet ray source 36). Among them, the intense ultraviolet ray source 34 delivers the ultraviolet ray onto the medium 50 at a position that is closer to the inkjet heads 12*y-k* on the platen 18 and the like, for example. Due to this, the intense ultraviolet ray source 34 causes the ink curing to progress at an early stage after printing by the inkjet heads 12*y-k*. By configuring as above, for example, the state of the printed surface can be stabilized at an earlier stage in the transferring pass of the medium 50 after printing by the inkjet heads 12*y-k*.

Further, the ultraviolet ray source 36 delivers the ultraviolet ray on the downstream side from the intense ultraviolet ray source 34 in the transferring direction of the medium 50. By configuring as above, the ink curing can be completed more thoroughly. As the intense ultraviolet ray source 34 and ultraviolet ray source 36, for example, a germicidal lamp, a black light, UV LED and the like can suitably be used. Further, if the ink can sufficiently be cured only by the intense ultraviolet ray source 34, then the ultraviolet ray source 36 may be omitted.

Here, as in the present embodiment, even in using the solvent UV ink, the organic solvent and the like being the solvent needs to be evaporated to fix the ink onto the medium 50. Further, as a result, similar to the case of using the solvent ink and the like, if printing is performed by the inkjet printer with the conventional configuration, it becomes difficult to suitably satisfy both the condition for preventing the smearing of the printed object and the condition for endowing the glossiness to the printed object.

Contrary to this, according to the present embodiment, for example, the condition for preventing the smearing of the printed object and the condition for endowing the glossiness to the printed object can more appropriately be satisfied even in the case of using the solvent UV ink. Further, the heating temperature of the medium does not need to be set excessively high. Due to this, according to this embodiment, for example, the high quality printing can more suitably be performed in the case of using the solvent UV ink.

As above, the present invention has been described by using embodiments, however, the technical scope of the present invention is not limited to the scope described in the embodiments. It is apparent to those skilled in the art that various modifications and improvements can be made to the above embodiments. It is apparent from the description of the claims that embodiments including such modifications and improvements are within the technical scope of the present invention.

INDUSTRIAL APPLICABILITY

The present invention can suitably be applied for example to an inkjet printer.

DESCRIPTION OF REFERENCE SIGNS

10 . . . inkjet printer
12*y*, 12*m*, 12*c*, 12*k* . . . inkjet head
14 . . . main-scan driving unit
16 . . . sub-scan driving unit (opposing position changing unit)
18 . . . platen
20 . . . platen heater
22 . . . after-heater
24 . . . warm/hot air heater
26 . . . dew condensation preventing fan

28 . . . cooling fan
30 . . . control unit
32*y*, 32*m*, 32*c*, 32*k* . . . weak UV source
34 . . . intense ultraviolet source
36 . . . ultraviolet source
50 . . . medium
102 . . . pre-heater
104 . . . print heater (medium heating heater)
202*y*, 202*m* . . . dot
204 . . . arrow
302 . . . solid line
304 . . . solid line
306 . . . arrow
308 . . . broken line
402*y*, 402*m*, 402*c*, 402*k* . . . layer

The invention claimed is:

1. An inkjet printer that performs printing on a medium by an inkjet scheme, the inkjet printer comprising:

a plurality of inkjet heads that respectively discharge ink droplets of ink of different colors;

a medium heating heater that heats the medium onto which the ink droplets were discharged from the respective inkjet heads, by being arranged at a position opposing the plurality of inkjet heads with the medium intervened in between;

an opposing position changing unit that sequentially causes each position of the medium in a moving direction to oppose the respective inkjet heads, by feeding the medium in the moving direction that is predeterminedly and relatively set with respect to the plurality of inkjet heads;

a main-scan driving unit that causes each of the plurality of inkjet heads to perform a main scanning operation to discharge ink droplets while moving in a main scanning direction that vertically intersects the moving direction, wherein the plurality of inkjet heads respectively discharge the ink droplets of the ink of the different colors to regions that are parts of the medium by being arranged with their positions in the moving direction being offset each other, the regions being at positions that are different in the moving direction, the ink droplets discharged from the most upstream inkjet head are not completely cured until the ink droplets are moved downstream of the most downstream inkjet head, the ink is ink that contains a solvent, and is fixed onto the medium by the solvent being dried, and the medium heating heater dries the ink that has been discharged from one of the inkjet heads and struck onto the medium by a time when another one of the inkjet heads further discharges an ink droplet to the struck position of the ink, an interval in the moving direction of the plurality of inkjet heads is equal to or more than a length in the moving direction of the regions where printing is to be performed by one printing operation, while a heating temperature by the medium heating heater is set corresponding to the interval between the plurality of inkjet heads and a speed of the medium being fed.

2. The inkjet printer according to claim 1, wherein the medium heating heater heats the medium so that a maximum temperature of the medium is 70° C. or lower.

3. The inkjet printer according to claim 1, wherein after when an ink droplet discharged from one of the inkjet heads has struck onto a first striking position in the moving direction, the opposing position changing unit causes a subsequent one of the inkjet heads adjacent to the one inkjet head in the moving direction to oppose the first striking position in the medium by relatively feeding the medium in the moving direction with respect to the plurality of inkjet heads, the subsequent inkjet head discharges an ink droplet toward the first striking position in a state where the subsequent inkjet head opposes the first striking position, and the one inkjet head discharges an ink droplet toward a second striking position of which position in the moving direction is different from the first striking position.

4. The inkjet printer according to claim 1, wherein the opposing position changing unit relatively feeds the medium in the moving direction with respect to the plurality of inkjet heads in between the main scanning operations by the plurality of inkjet heads, and the interval in the moving direction of the plurality of inkjet heads is equal to or more than a length in a sub scanning direction of the regions where printing is to be performed by one main scanning operation.

5. The inkjet printer according to claim 1, wherein the ink is aqueous ink in which a main component of the solvent is water, or is solvent ink in which a main component of the solvent is organic solvent.

6. The inkjet printer according to claim 1, wherein the ink is latex ink.

7. The inkjet printer according to claim 1, wherein the ink includes a polymeric substance that is polymerized by ultraviolet ray irradiation and the solvent that dilutes the polymeric substance, the inkjet printer further comprises an ultraviolet ray irradiation unit that delivers ultraviolet ray for curing the ink that has struck the medium, the medium heating heater dries the ink in a state where curing by the ultraviolet ray irradiation has not yet been completed, and the ultraviolet ray irradiation unit completes the curing of the ink by delivering the ultraviolet ray after the ink droplets has been discharged by the plurality of inkjet heads onto respective portions in the medium in the moving direction.

8. A printing method for performing printing on a medium by an inkjet scheme, the printing method using:

a plurality of inkjet heads that respectively discharge ink droplets of ink of different colors;

a medium heating heater that heats the medium onto which the ink droplets have been discharged from the respective inkjet heads, by being arranged at a position opposing the plurality of inkjet heads with the medium intervened in between;

an opposing position changing unit that sequentially causes each position of the medium in a moving direction to oppose the respective inkjet heads, by feeding the medium in the moving direction that is predeterminedly and relatively set with respect to the plurality of inkjet heads;

a main-scan driving unit that causes each of the plurality of inkjet heads to perform a main scanning operation to discharge ink droplets while moving in a main scanning direction that vertically intersects the moving direction, wherein the plurality of inkjet heads respectively discharge the ink droplets of the ink of the different colors to regions that are parts of the medium by being arranged with their positions in the moving direction being offset each other, the regions being at positions that are different in the moving direction, the ink droplets discharged from the most upstream inkjet head are not completely cured until the ink droplets are moved downstream of the most downstream inkjet head, the ink is ink that contains a solvent, and is fixed onto the medium by the solvent being dried, and the ink that has been discharged from one of the inkjet heads and struck onto the medium is dried by the medium heating heater by a time when another one of the inkjet heads further discharges an ink droplet to the struck position of the ink, an interval in the moving direction of the plurality of inkjet heads is equal to or more than a length in the moving direction of the regions where printing is to be performed by one printing operation, while a heating temperature by the medium heating heater is set corresponding to the interval between the plurality of inkjet heads and a speed of the medium being fed.

* * * * *